US006391838B1

(12) United States Patent
Speckmann et al.

(10) Patent No.: US 6,391,838 B1
(45) Date of Patent: May 21, 2002

(54) DETERGENTS CONTAINING ENZYMES AND BLEACH ACTIVATORS

(75) Inventors: Horst-Dieter Speckmann, Langenfeld; Joerg Poethkow, Duesseldorf, both of (DE)

(73) Assignee: Henkel Kommanditgesellschaft auf Aktien, Duessseldorf (DE)

( * ) Notice: Subject to any disclaimer, the term of this patent is extended or adjusted under 35 U.S.C. 154(b) by 0 days.

(21) Appl. No.: 09/539,604

(22) Filed: Mar. 31, 2000

(30) Foreign Application Priority Data

Mar. 31, 1999 (DE) ..... 199 14 811

(51) Int. Cl.[7] ..... C11D 1/62; C11D 3/395

(52) U.S. Cl. ..... 510/312; 510/276; 510/286; 510/300; 510/302; 510/305; 510/310; 510/314; 510/320; 510/400; 510/517; 510/518; 510/528

(58) Field of Search ..... 510/276, 286, 510/300, 302, 305, 310, 312, 314, 320, 400, 518, 517, 528

(56) References Cited

U.S. PATENT DOCUMENTS

| | | | | |
|---|---|---|---|---|
| 3,234,258 A | | 2/1966 | Morris | 260/460 |
| 4,435,307 A | | 3/1984 | Barbesgaard et al. | 252/174.12 |
| 4,443,355 A | | 4/1984 | Murata et al. | 252/174.12 |
| 4,585,642 A | | 4/1986 | Rieck | 423/333 |
| 4,664,839 A | | 5/1987 | Rieck | 252/175 |
| 4,820,439 A | | 4/1989 | Rieck | 252/135 |
| 4,915,863 A | * | 4/1990 | Aoyagi et al. | 252/102 |
| 4,945,053 A | | 7/1990 | Ito et al. | 435/209 |
| 4,985,553 A | | 1/1991 | Fuertes et al. | 536/124 |
| 5,075,041 A | | 12/1991 | Lutz | 252/548 |
| 5,132,036 A | * | 7/1992 | Falout et al. | 252/90 |
| 5,183,651 A | | 2/1993 | Schimmel et al. | 423/334 |
| 5,229,095 A | | 7/1993 | Schimmel et al. | 423/334 |
| 5,231,006 A | | 7/1993 | Kolde | 435/13 |
| 5,236,682 A | | 8/1993 | Schimmel et al. | 423/334 |
| 5,268,156 A | | 12/1993 | Schimmel et al. | 423/334 |
| 5,308,596 A | | 5/1994 | Kotzian et al. | 423/333 |
| 5,318,733 A | | 6/1994 | Carduck et al. | 264/15 |
| 5,356,607 A | | 10/1994 | Just | 423/334 |
| 5,382,377 A | | 1/1995 | Raehse et al. | 252/174 |
| 5,417,951 A | | 5/1995 | Just | 423/334 |
| 5,494,482 A | | 2/1996 | Sakamoto et al. | 425/185 |
| 5,541,316 A | | 7/1996 | Engelskirchen et al. | 510/471 |
| 5,580,941 A | | 12/1996 | Krause et al. | 527/300 |
| 5,616,550 A | | 4/1997 | Kruse et al. | 510/444 |
| 5,783,616 A | | 7/1998 | Krause et al. | 524/58 |
| 5,798,328 A | | 8/1998 | Kottwitz et al. | 510/438 |
| 5,830,956 A | | 11/1998 | Stackhausen et al. | 526/318.2 |
| 5,847,065 A | | 12/1998 | Krause et al. | 527/300 |
| 5,854,191 A | | 12/1998 | Krause et al. | 510/276 |
| 5,854,321 A | | 12/1998 | Krause et al. | 524/58 |
| 5,922,670 A | | 7/1999 | Knuebel et al. | 510/426 |
| 5,972,668 A | | 10/1999 | Georg et al. | 435/188 |
| 6,075,001 A | | 6/2000 | Wilde | 510/376 |

FOREIGN PATENT DOCUMENTS

| | | |
|---|---|---|
| CA | 1 036 455 | 8/1978 |
| CA | 1 232 108 | 2/1988 |
| DE | 24 12 837 | 10/1974 |
| DE | 28 57 292 | 12/1980 |
| DE | 32 07 825 | 9/1982 |
| DE | 32 07 847 | 9/1982 |
| DE | 33 22 950 | 1/1984 |
| DE | 33 24 258 | 1/1984 |
| DE | 31 17 250 | 12/1991 |
| DE | 42 21 381 | 2/1994 |
| DE | 43 21 022 | 1/1995 |

(List continued on next page.)

OTHER PUBLICATIONS

Progr.Phys.Org.Chem, 11, Pg. (1974).
J.Am.Chem.Soc, 102 Pg.5892 (1980).
J.Biol.Chem. 177 pg.751–766 (1948).
Tenside 7, 125 (170) date unavailable.
S.P.Colowick and N.D.Kaplan, Methods I Enzymology, vol. 1 p. 149 (1955).
Agric. Biol. 53, p. 1275 (1989).
Hoechst High Chem. Magazin, 14, pp. 33–38 (1993).
Seifen–Loe–Fette–Wachse, vol. 116, No.20, pp. 805–808 (1990).
Derwent Patent Abstract No. 2000–054358 [05].
Derwent Patent Abstract No. 1981–83568D [46].
Derwent Patent Abstract No. 1982–79249E [38].

(List continued on next page.)

*Primary Examiner*—Charles Boyer
(74) *Attorney, Agent, or Firm*—Glenn E. J. Murphy

(57) ABSTRACT

The cleaning performance of bleach-containing detergents, especially against protein- and starch-containing soils and colored soils, was to be improved. This was essentially achieved through the presence in the detergent—besides typical ingredients compatible with such components—of a compound corresponding to general formula I:

(I)

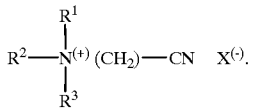

in which $R^1$ represents —H, —$CH_3$, a $C_{2-24}$ alkyl or alkenyl group, a substituted $C_{2-24}$ alkyl or alkenyl group with at least one substituent from the group consisting of —Cl, —Br, —OH, —$NH_2$, —CN, an alkyl or alkenyl aryl group containing a $C_{1-24}$ alkyl group or a substituted alkyl or alkenyl aryl group containing a $C_{1-24}$ alkyl group and at least one other substituent at the aromatic ring, $R^2$ ad $R^3$ independently of one another are selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H where n=1, 2, 3, 4, 5 or 6 and X is an anion, and an enzyme selected from the group consisting of protease, amylase, lipase, cellulase and mixtures thereof.

27 Claims, No Drawings

FOREIGN PATENT DOCUMENTS

| | | |
|---|---|---|
| DE | 44 16 438 | 11/1995 |
| DE | 44 17 734 | 11/1995 |
| DE | 43 03 320 | 12/1995 |
| DE | 44 43 177 | 6/1996 |
| DE | 195 03 061 | 8/1996 |
| DE | 195 13 391 | 10/1996 |
| DE | 195 29 905 | 2/1997 |
| DE | 43 00 772 | 3/1997 |
| DE | 195 36 082 | 4/1997 |
| DE | 196 05 688 | 8/1997 |
| DE | 196 13 103 | 10/1997 |
| DE | 196 20 411 | 10/1997 |
| DE | 196 16 693 | 11/1997 |
| DE | 196 16 767 | 11/1997 |
| DE | 196 16 769 | 11/1997 |
| DE | 196 16 770 | 11/1997 |
| DE | 196 20 267 | 11/1997 |
| DE | 198 19 187 | 11/1999 |
| DE | 198 24 687 | 12/1999 |
| EP | 0 486 592 | 5/1957 |
| EP | 0 001 305 | 4/1979 |
| EP | 0 164 514 | 12/1985 |
| EP | 0 164 552 | 12/1985 |
| EP | 0 204 208 | 12/1986 |
| EP | 0 214 761 | 3/1987 |
| EP | 0 232 202 | 8/1987 |
| EP | 0 241 985 | 10/1987 |
| EP | 0 253 567 | 1/1988 |
| EP | 0 258 068 | 3/1988 |
| EP | 0 265 832 | 5/1988 |
| EP | 0 269 977 | 6/1988 |
| EP | 0 270 974 | 6/1988 |
| EP | 0 272 030 | 6/1988 |
| EP | 0 273 125 | 7/1988 |
| EP | 0 274 907 | 7/1988 |
| EP | 0 264 753 | 12/1988 |
| EP | 0 339 550 | 11/1989 |
| EP | 0 357 280 | 3/1990 |
| EP | 0 385 401 | 9/1990 |
| EP | 0 392 592 | 10/1990 |
| EP | 0 394 352 | 10/1990 |
| EP | 0 398 133 | 11/1990 |
| EP | 0 398 137 | 11/1990 |
| EP | 0 407 225 | 1/1991 |
| EP | 0 416 967 | 3/1991 |
| EP | 0 425 427 | 5/1991 |
| EP | 0 436 835 | 7/1991 |
| EP | 0 443 651 | 8/1991 |
| EP | 0 446 982 | 9/1991 |
| EP | 0 425 428 | 10/1991 |
| EP | 0 453 003 | 10/1991 |
| EP | 0 458 397 | 11/1991 |
| EP | 0 458 398 | 11/1991 |
| EP | 0 471 265 | 2/1992 |
| EP | 0 502 325 | 9/1992 |
| EP | 0 525 239 | 2/1993 |
| EP | 0 544 490 | 6/1993 |
| EP | 0 544 519 | 6/1993 |
| EP | 0 548 599 | 6/1993 |
| EP | 0 549 271 | 6/1993 |
| EP | 0 549 272 | 6/1993 |
| EP | 0 571 982 | 12/1993 |
| EP | 0 625 992 | 11/1994 |
| EP | 0 642 576 | 3/1995 |
| EP | 0 693 550 | 1/1996 |
| EP | 0 832 969 | 4/1998 |
| GB | 2 094 826 | 9/1982 |
| GB | 2 095 275 | 9/1982 |
| JP | 58/17598 | 12/1983 |
| JP | 04/238809 | 8/1992 |
| JP | 04/260610 | 9/1992 |
| WO | WO87/00859 | 2/1987 |
| WO | WO88/03946 | 6/1988 |
| WO | WO88/03947 | 6/1988 |
| WO | WO90/13533 | 1/1990 |
| WO | WO90/10695 | 9/1990 |
| WO | WO91/02792 | 3/1991 |
| WO | WO91/08171 | 6/1991 |
| WO | WO92/07067 | 4/1992 |
| WO | WO92/18542 | 10/1992 |
| WO | WO94/18314 | 8/1994 |
| WO | WO96/23860 | 8/1994 |
| WO | WO94/23005 | 10/1994 |
| WO | WO94/28102 | 12/1994 |
| WO | WO94/28103 | 12/1994 |
| WO | WO894/27970 | 12/1994 |
| WO | WO95/00626 | 1/1995 |
| WO | WO95/07331 | 3/1995 |
| WO | WO95/14075 | 5/1995 |
| WO | WO95/14759 | 6/1995 |
| WO | WO95/17498 | 6/1995 |
| WO | WO95/19954 | 7/1995 |
| WO | WO95/19955 | 7/1995 |
| WO | WO96/19953 | 7/1995 |
| WO | WO90/22592 | 8/1995 |
| WO | WO95/21247 | 8/1995 |
| WO | WO95/27775 | 10/1995 |
| WO | WO96/00772 | 1/1996 |
| WO | WO96/00773 | 1/1996 |
| WO | WO96/23859 | 8/1996 |
| WO | WO96/23861 | 8/1996 |
| WO | WO96/34108 | 10/1996 |
| WO | WO97/34005 | 9/1997 |

OTHER PUBLICATIONS

Derwent Patent Abstract No. 1982–79251E [38].
Derwent Patent Abstract No. 1984–019010 [04].
Derwent Patent Abstract No. 1996–050519 [06].
Derwent Patent Abstract No. 1996–050463 [06].
Derwent Patent Abstract No. 1984–026893 [05].
Derwent Patent Abstract No. 1990–336011 [45].
Derwent Patent Abstract No. 1995–037141 [06].
Derwent Patent Abstract No. 1996–371329 [37].
Derwent Patent Abstract No. 1996–456404 [46].
Derwent Patent Abstract No. 1993–259656 [33].
Derwent Patent Abstract No. 1987–223150 [32].
Derwent Patent Abstract No. 1994–035002 [04].
Derwent Patent Abstract No. 1994–235530 [29].
Derwent Patent Abstract No. 1994–280420 [35].
Derwent Patent Abstract No. 1996–000404 [01].
Derwent Patent Abstract No. 1974–75753V [44].
Derwent Patent Abstract No. 1991–126877 [18].
Derwent Patent Abstract No. 1985–270605 [44].
Derwent Patent Abstract No. 1991–172613 [24].
Derwent Patent Abstract No. 1992–335303 [41].
Derwent Patent Abstract No. 1992–360500 [41].
Derwent Patent Abstract No. 1993–206465 [26].
Derwent Patent Abstract No. 1992–301673 [37].
Derwent Patent Abstract No. 1991–126878 [18].
Derwent Patent Abstract No. 1991–209554 [29].
Derwent Patent Abstract No. 1985–290431 [47].
Derwent Patent Abstract No. 1988–113473 [17].
Derwent Patent Abstract No. 2000–024443 [03].
Derwent Patent Abstract No. 1995–293791 [39].
Derwent Patent Abstract No. 1997–551016 [51].
Derwent Patent Abstract No. 1997–551018 [51].
Derwent Patent Abstract No. 1997–537244 [50].

Derwent Patent Abstract No. 1997–537245 [50].
Derwent Patent Abstract No. 1995–186717 [25].
Derwent Patent Abstract No. 1996–287166 [29].
Derwent Patent Abstract No. 1997–133790 [13].
Derwent Patent Abstract No. 1998–019669 [03].
Derwent Patent Abstract No. 1997–204334 [19].
Derwent Patent Abstract No. 1997–416938 [39].
Derwent Patent Abstract No. 1997–481969 [45].
Derwent Patent Abstract No. 1996–011551 [02].
Derwent Patent Abstract No. 1998–181222 [17].
Derwent Patent Abstract No. 1997–481903 [45].
Derwent Patent Abstract No. 1978–72508A [40].
Derwent Patent Abstract No. 1984–019090 [04].
Derwent Patent Abstract No. 1991–073523 [10].
Derwent Patent Abstract No. 1993–386559 [48].

* cited by examiner

DETERGENTS CONTAINING ENZYMES AND BLEACH ACTIVATORS

BACKGROUND OF THE INVENTION

1. Field of the Invention

This invention relates to enzyme-containing detergents which, besides typical ingredients, contain a certain bleach activator from the group of cationic nitrites.

2. Discussion of Related Art

Besides the ingredients essential to the washing process, such as surfactants and builders, detergents generally contain other ingredients which may be collectively referred to as washing aids and which comprise such different groups of ingredients as foam regulators, redeposition inhibitors, bleaching agents and dye transfer inhibitors. The washing aids in question also include substances which support cleaning performance through the enzymatic degradation of soils present on the fabric. The same also applies to detergents for cleaning hard surfaces. Besides the proteases which assist in removing proteins and the lipolytic lipases, particular significance attaches to the amylases, of which the function is to facilitate the removal of starch-containing soils through the catalytic hydrolysis of the starch polysaccharide, and to the cellulases. Cellulases have been known for some time as softeners for cotton fabrics by virtue of their ability to degrade cellulose. So far as the relevant action mechanism is concerned, it is assumed that fabric-softening cellulases preferentially hydrolyze and remove microfibrous cellulose, so-called fibrils, which projects from the surface of the cotton fibers and prevents them from sliding freely over one another. In addition, a side effect of this degradation of fibrils is the strengthening of the visual color impression.

Other typical ingredients of detergents are active substances which are intended to improve the bleaching performance of the peroxygen bleaching agent normally present in such compositions. Thus, inorganic peroxygen compounds, more particularly hydrogen peroxide and solid peroxygen compounds, which dissolve in water and release hydrogen peroxide in the process, such as sodium perborate and sodium carbonate perhydrate, have long been used as oxidizing agents for disinfecting and bleaching purposes. The oxidizing effect of these substances in dilute solutions depends to a large extent on the temperature. For example, with $H_2O_2$ or perborate in alkaline bleaching liquors, soiled textiles are only bleached sufficiently quickly at temperatures above about 60° C. At lower temperatures, the oxidizing effect of the inorganic peroxygen compounds can be improved by the addition of so-called bleach activators, for which numerous proposals have become known in the literature, above all from the classes of N- or O-acyl compounds, for example polyacylated alkylene-diamines, more especially tetraacetyl ethylenediamine, acylated glycol urils, more especially tetraacetyl glycol uril, N-acylated hydantoins, hydrazides, triazoles, hydrotriazines, urazoles, diketopiperazines, sulfuryl amides and cyanurates, also carboxylic anhydrides, more especially phthalic anhydride, carboxylic acid esters, more especially sodium nonanoyloxybenzenesulfonate, sodium isononanoyloxybenzenesulfonate, and acylated sugar derivatives, such as pentaacetyl glucose. By adding these substances, the bleaching effect of aqueous peroxide liquors can be increased to such an extent that substantially the same effects are obtained at temperatures of only around 60° C. as are obtained with the peroxide liquor alone at 95° C.

Detergents containing a naturally occurring α-amylase and a bleach-activating agent of the acetonitrile derivative type are known from hitherto unpublished German patent application DE 198 24 687.

It has surprisingly been found that the combination of certain bleach-activating agents of the acetonitrile derivative type with enzymes leads to unexpected synergistic improvements in performance when it is used in detergents.

DESCRIPTION OF THE INVENTION

The present invention relates to a bleach-containing detergent which contains a compound corresponding to general formula I:

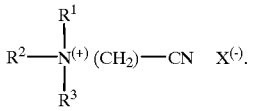

(I)

in which $R^1$ represents —H, —$CH_3$, a $C_{2-24}$ alkyl or alkenyl group, a substituted $C_{2-24}$ alkyl or alkenyl group with at least one substituent from the group consisting of —Cl, —Br, —OH, —$NH_2$, —CN, an alkyl or alkenyl aryl group containing a $C_{1-24}$ alkyl group or a substituted alkyl or alkenyl aryl group containing a $C_{1-24}$ alkyl group and at least one other substituent at the aromatic ring, $R^2$ ad $R^3$ independently of one another are selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H where n=1, 2, 3, 4, 5 or 6 and X is an anion, and an enzyme selected from the group consisting of protease, amylase, lipase, cellulase and mixtures thereof besides typical detergent ingredients compatible with such components.

The present invention also relates to the use of a combination of acetonitrile derivative corresponding to formula (I) and an enzyme selected from the group consisting of protease, amylase, lipase, cellulase and mixtures thereof, for increasing the cleaning performance of detergents, more particularly against protein-containing, starch-containing and/or colored, more particularly tea-based, soils, where they are used in detergent solutions, particularly aqueous detergent solutions, containing a peroxygen compound. Cleaning performance against colored soils is meant to be interpreted in the broadest sense and encompasses both the bleaching of soil present on the fabric, the bleaching of soil present in the wash liquor after separation from the fabric and the oxidative destruction of textile dyes present in the wash liquor—having separated from textiles under the washing conditions—before they can attach themselves to differently colored fabrics. The cleaning performance of cleaning solutions for hard surfaces is also understood to encompass both the bleaching of soil present on the hard surface, more particularly tea, and the bleaching of soil present in the dishwashing liquor after separation from the hard surface.

Compounds corresponding to formula I may be produced by known methods as published in the patent literature cited above or, for example, by Abraham in Progr. Phys. Org. Chem. 11 (1974), pages 1 et seq. and by Arnett in J. Am. Chem. Soc. 102 (1980), pages 5892 et seq., or by similar methods.

Compounds corresponding to formula (I) in which $R^1$, $R^2$ and $R^3$ are the same are preferably used. Of these compounds, those in which the substituents mentioned represent methyl groups are preferred.

The anions X include in particular the halides, such as chloride, fluoride, iodide and bromide, nitrate, hydroxide, hexafluorophosphate, sulfate, hydrogen sulfate, metho- and ethosulfate, chlorate, perchlorate, and the anions of carboxylic acids, such as formate, acetate, benzoate or citrate. Compounds corresponding to formula I, in which X is chloride, sulfate, hydrogen sulfate or methosulfate, are preferably used.

An acetonitrile derivative corresponding to formula I is present in detergents according to the invention in quantities of preferably 1 to 10% by weight and more preferably 2 to 7% by weight.

A detergent according to the invention preferably contains 0.001 mg to 0.5 mg and, more particularly, 0.02 mg to 0.3 mg of enzymatically active protein per gram of the detergent as a whole. The protein concentration may be determined by known methods, for example by the bicinchonic acid process (BCA process, Pierce Chemical Co., Rockford, Ill.) or by the biuret process (A. G. Gornall, C. S. Bardawill and M. M. David, J. Biol. Chem. 177, 751–766, 1948).

Proteases which may be used in accordance with the invention include the enzymes obtainable from microorganisms, more especially bacteria or fungi, with an optimum pH in the alkaline range, for example the proteases known from International patent applications WO 92/07067, WO 91/02792, WO 88/03947 and WO 88/03946 and from European patent applications EP 471 265, EP 416 967 and EP 394 352. Protease is preferably used in the detergent according to the invention in such quantities that the final detergent contains 100 PU/g to 7500 PU/g (protease units per gram, as determined by the method described in Tenside 7, 125 (170)), preferably 125 PU/g to 5000 PU/g and more preferably 150 PU/g to 4500 PU/g. Suitable proteases are commercially obtainable, for example under the names of BLAP®, Savinase®, Esperase®, Maxatase®, Optimase®, Alcalase®, Durazym®, Everlase®, Maxapem® or Purafect® OxP.

The amylases suitable for use in detergents according to the invention, in which they are preferably used in combination with at least one other enzyme, include the enzymes obtainable from bacteria or fungi which preferably have an optimum pH in the alkaline range to about pH 10. Suitable commercial products are, for example, Termamyl®, Maxamyl®, Duramyl®, and Purafect® OxAm. Amylase is preferably used in the detergent according to the invention in such quantities that the final detergent contains 0.01 KNU/g to 1 KNU/g (kilo-novo units per gram as determined by the standard method developed by the Novo company, 1 KNU being the quantity of enzyme which degrades 5.26 g of starch at pH 5.6/37° C., on the basis of the method described by P. Bernfeld in S. P. Colowick and N. D. Kaplan, Methods in Enzymology, Vol. 1, 1955, page 149), preferably 0.015 KNU/g to 1.8 KNU/g and more preferably 0.03 KNU/g to 1.6 KNU/g. If the detergent according to the invention contains an amylase, it is preferably selected from the genetically modified amylases. Genetically modified amylases are known, for example, from International patent applications WO 94/18314 and WO 95/21247.

The lipase optionally present in the detergent according to the invention is an enzyme obtainable from microorganisms, more especially bacteria or fungi. One such lipase is known, for example, from European patent applications EP 0 204 208, EP 0 214 761, EP 0 258 068, EP 0 385 401, EP 0 407 225, EP 0 571 982 and from International patent applications WO 87/00859 and WO 90/10695. Lipase is preferably used in the detergent according to the invention in such quantities that the final detergent has a lipolytic activity in the range from 10 LU/g to 10,000 LU/g (lipase activity units per gram, as determined by the enzymatic hydrolysis of tributyrin at 30° C./pH 7 using the method described in EP 0 258 068), preferably in the range from 80 LU/g to 5000 LU/g and more preferably in the range from 100 LU/g to 1000 LU/g. Commercially available lipases are, for example, Lipolase®, Lipomax®, Lumafast® and Lipozym®.

The cellulase suitable for use in accordance with the invention also belongs to the enzymes obtainable from bacteria or fungi which have an optimum pH preferably in the almost neutral to weakly alkaline pH range of 6 to 9.5. Corresponding cellulases are known, for example, from DE-A-31 17 250, DE-A-32 07 825, DE-A-32 07 847, DE-A-33 22 950, from European patent applications EP 265 832, EP 269 977, EP 270 974, EP 273 125 and EP 339 550 and from International patent applications WO 96/34108 and WO 97/34005. They are preferably used in the detergent according to the invention in such quantities that the final detergent has a cellulolytic activity of 0.05 IU/g to 1.5 IU/g (international units per gram, based on the enzymatic hydrolysis of Na carboxymethyl cellulose at pH 9.0/40° C., as described by S. Ito et al. in Agric. Biol. Chem. 53, 1275 (1989)), preferably 0.07 IU/g to 1.4 IU/g and more preferably 0.1 IU/g to 1.3 IU/g. Suitable commercial products are, for example, Celluzyme® (Novo Nordisk) and KAC® (Kao).

If several enzymes are to be used in the detergent according to the invention, this may be done by incorporating the two or more separate or separately made-up enzymes or by incorporating two or more enzymes made-up together in the same granules, as known for example from International patent applications WO 96/00772 and WO 96/00773.

Peroxygen compounds suitable for use in detergents according to the invention include, in particular, hydrogen peroxide and inorganic salts which release hydrogen peroxide under washing conditions, including alkali metal perborates, percarbonates, persilicates and/or persulfates, such as caroate, and also organic per acids or peracidic salts of organic acids, such as phthalimidopercaproic acid, perbenzoic acid or salts of diperdodecanedioic acid. If solid peroxygen compounds are to be used, they may be used in the form of powders or granules which may also be coated in known manner. Peroxygen compounds are present in quantities of preferably up to 50% by weight, more preferably from 5% by weight to 30% by weight and most preferably from 8% by weight to 25% by weight. The addition of small quantities of known bleach stabilizers, for example phosphonates, borates or metaborates and metasilicates, and magnesium salts, such as magnesium sulfate, can be useful.

The use according to the invention essentially consists in creating conditions—in the presence of a surface soiled with protein-containing, starch-containing and/or colored soils—under which a peroxidic oxidizing agent and the acetonitrile derivative/enzyme combination crucial to the invention can react with one another. Such conditions prevail in particular when all the reactants meet one another in aqueous solution. This can be achieved by separately adding the peroxygen compound and the active-substance combination to an optionally detergent-containing solution, but is achieved with particular advantage using a dishwashing detergent according to the invention which contains the combination of acetonitrile derivative and enzyme and a peroxygen-containing oxidizing agent.

Besides the active-substance combination used in accordance with the invention, the detergents according to the invention—which may be present as, in particular, powderform solids, as post-compacted particles or as homogeneous solutions or suspensions—may in principle contain any known ingredients typically encountered in detergents. More particularly, the detergents according to the invention may contain builders, surfactants, additional bleaching agents based on organic and/or inorganic peroxygen compounds, additional bleach activators, water-miscible organic solvents, additional enzymes, sequestering agents, electrolytes, pH regulators and other auxiliaries, such as optical brighteners, redeposition inhibitors, dye transfer inhibitors, foam regulators, silver corrosion inhibitors and dyes and perfumes.

The detergents according to the invention may contain one or more surfactants, more particularly anionic surfactants, nonionic surfactants and mixtures thereof, but also cationic, zwitterionic and amphoteric surfactants.

Suitable nonionic surfactants are, in particular, alkyl glycosides and ethoxylation and/or propoxylation products of alkyl glycosides or linear or branched alcohols containing 12 to 18 carbon atoms in the alkyl moiety and 3 to 20 and preferably 4 to 10 alkyl ether groups. Corresponding ethoxylation and/or propoxylation products of N-alkylamines, vicinal diols, fatty acid esters and fatty acid amides, which correspond to the long-chain alcohol derivatives mentioned in regard to the alkyl moiety, and of alkyl phenols containing 5 to 12 carbon atoms in the alkyl group are also suitable.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol group may be linear or, preferably, 2-methyl-branched or may contain linear and methyl-branched groups in the form of the mixtures typically present in oxoalcohol groups. However, alcohol ethoxylates containing linear groups of alcohols of native origin with 12 to 18 carbon atoms, for example coconut alcohol, palm alcohol, tallow alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 7 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are (tallow) fatty alcohols containing 14 EO, 16EO, 20EO, 25 EO, 30 EO or 40 EO. In dishwasher detergents in particular, extremely low-foaming surfactants are normally used. These preferably include $C_{12-18}$ alkyl polyethylene glycol polypropylene glycol ethers containing up to 8 moles ethylene oxide and up to 8 moles propylene oxide units in the molecule. However, other known low-foaming nonionic surfactants, for example $C_{12-18}$ alkyl polyethylene glycol polybutylene glycol ethers containing up to 8 moles ethylene oxide and up to 8 moles butylene oxide units in the molecule and end-capped alkyl polyalkylene glycol mixed ethers, may also be used. The hydroxy-functional alkoxylated alcohols described in European patent application EP 0 300 305, so-called hydroxy mixed ethers, are also particularly preferred. The nonionic surfactants also include alkyl glycosides with the general formula $RO(G)_x$ where R is a primary, linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of mono- and oligoglycosides, is a number (which, as an analytically determined quantity, may also be a broken number) of 1 to 10; preferably x=1.2 to 1.4. Other suitable nonionic surfactants are polyhydroxyfatty acid amides corresponding to formula (II):

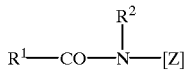

(II)

in which $R^1CO$ is an aliphatic acyl group containing 6 to 22 carbon atoms, $R^2$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are preferably derived from reducing sugars containing 5 or 6 carbon atoms, more particularly from glucose. The group of polyhydroxyfatty acid amides also includes compounds corresponding to formula (III):

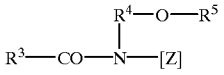

(III)

in which $R^3$ is a linear or branched alkyl or alkenyl group containing 7 to 12 carbon atoms, $R^4$ is a linear, branched or cyclic alkylene group or an arylene group containing 2 to 8 carbon atoms and $R^5$ is a linear, branched or cyclic alkyl group or an aryl group or a hydroxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of such a group. Again, [Z] is preferably obtained by reductive amination of a sugar, for example glucose, fructose, maltose, lactose, galactose, mannose or xylose. The N-alkoxy or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331. Another class of preferred nonionic surfactants which are used either as sole nonionic surfactant or in combination with other nonionic surfactants, particularly together with alkoxylated fatty alcohols and/or alkyl glycosides, are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO 90/13533. Nonionic surfactants of the amine oxide type, for example N-coconutalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more, in particular no more than half, the quantity of ethoxylated fatty alcohols used. Other suitable surfactants are so-called gemini surfactants. Gemini surfactants are generally understood to be compounds which contain two hydrophilic groups and two hydrophobic groups per molecule. These groups are generally separated from one another by a so-called "spacer". The spacer is generally a carbon chain which should be long enough for the hydrophilic groups to have a sufficient spacing to be able to act independently of one another. Gemini surfactants are generally distinguished by an unusually low critical micelle concentration and by an ability to reduce the surface tension of water to a considerable extent. In exceptional cases, however, gemini surfactants are not only understood to be "dimeric" surfactants, but also "trimeric" surfactants. Suitable gemini surfactants are, for example, the sulfated hydroxy mixed ethers according to German patent application DE 43 21 022 and the dimer alcohol bis- and trimer alcohol tris-sulfates and -ether sulfates according to earlier German patent application DE 195 03 061. The end-capped dimeric and trimeric mixed ethers according to German patent application DE 195 13 391 are distinguished in particular by their bifunctionality and multifunctionality. Thus, the end-capped surfactants mentioned exhibit good wetting properties and are low-foaming so that they are particularly suitable for use in machine washing or cleaning processes. However, the gemini polyhydroxyfatty amides or poly-polyhydroxyfatty acid amides described in International patent applications WO 95/19953, WO 95/19954 and WO 95/19955 may also be used.

Suitable anionic surfactants are in particular soaps and those containing sulfate or sulfonate groups. Suitable surfactants of the sulfonate type are preferably $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes by sulfochlorination or sulfoxidation and subsequent hydrolysis or neutralization. The esters of α-sulfofatty acids (ester sulfonates), for example the α-sulfonated methyl esters of hydrogenated coconut, palm kernel or tallow acids, which are obtained by α-sulfonation of the methyl esters of fatty acids of vegetable and/or animal origin containing 8 to 20 carbon atoms in the fatty acid molecule and subsequent neutralization to water-soluble monosalts are also suitable. The esters in question are preferably the α-sulfonated esters of hydrogenated coconut, palm, palm kernel or tallow acid, although sulfonation products of unsaturated fatty acids, for example oleic acid, may also be present in small quantities, preferably in quantities of not more than about 2 to 3% by weight. α-Sulfofatty acid alkyl esters with an alkyl chain of not more than 4 carbon atoms in the ester group, for example methyl esters, ethyl esters, propyl esters and butyl esters, are particularly preferred. The methyl esters of α-sulfofatty acids (MES) and saponified disalts thereof are used with particular advantage. Other suitable anionic surfactants are sulfonated fatty acid glycerol esters, i.e. the monoesters, diesters and triesters and mixtures thereof which are obtained where production is carried out by esterification by a monoglycerol with 1 to 3 moles of fatty acid or in the transesterification of triglycerides with 0.3 to 2 moles of glycerol. Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates and $C_{12-15}$ alkyl sulfates and also $C_{14-15}$ alkyl sulfates are particularly preferred from the washing performance point of view. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®. The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. Other preferred anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol molecules or mixtures thereof. Particularly preferred sulfosuccinates contain a fatty alcohol molecule derived from ethoxylated fatty alcohols which, considered in isolation, represent nonionic surfactants. Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used. Other suitable anionic surfactants are fatty acid derivatives of amino acids, for example of N-methyl taurine (taurides) and/or of N-methyl glycine (sarcosides). The sarcosides or rather sarcosinates, above all sarcosinates of higher and optionally mono- or poly-unsaturated fatty acids, such as oleyl sarcosinate, are particularly preferred. Other suitable anionic surfactants are, in particular, soaps. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example coconut, palm kernel or tallow acids. The known alkenyl succinic acid salts may be used together with or as a substitute for soaps.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Surfactants are present in the laundry detergents according to the invention in quantities of preferably 5% by weight to 50% by weight and more preferably in quantities of 8% by weight to 30% by weight whereas detergents for cleaning hard surfaces, particularly dishwasher detergents, have lower surfactant contents of up to 10% by weight, preferably up to 5% by weight and more preferably in the range from 0.5% by weight to 3% by weight.

A laundry detergent according to the invention contains at least one water-soluble and/or water-insoluble, organic and/or inorganic builder. Suitable water-soluble organic builders include polycarboxylic acids, more particularly citric acid and sugar acids, monomeric and polymeric aminopolycarboxylic acids, more particularly methyl glycine diacetic acid, nitrilotriacetic acid and ethylenediamine tetraacetic acid and polyaspartic acid, polyphosphonic acids, more especially aminotris(methylene phosphonic acid), ethylenediamine tetrakis(methylene phosphonic acid) and 1-hydroxyethane-1,1-diphosphonic acid, polymeric hydroxy compounds, such as dextrin, and polymeric (poly)carboxylic acids, more particularly the polycarboxylates obtainable by oxidation of polysaccharides or dextrins according to European patent 0 625 992 or International patent application WO 92/18542 or European patent EP 0 232 202, polymeric acrylic acids, methacrylic acids, maleic acids and copolymers thereof which may also contain small amounts of polymerizable substances with no carboxylic acid functionality in copolymerized form. The relative molecular weight of the homopolymers of unsaturated carboxylic acids is generally between 3,000 and 200,000 while the relative molecular weight of the copolymers is between 2,000 and 200,000 and preferably between 30,000 and 120,000, based on free acid. A particularly preferred acrylic acid/maleic acid copolymer has a relative molecular weight of 30,000 to 100,000. Commercial products are, for example, Sokalan® CP 5, CP 10 and PA 30 of BASF. Suitable, but less preferred, compounds of this class are copolymers of acrylic acid or methacrylic acid with vinyl ethers, such as vinyl methyl ethers, vinyl esters, ethylene, propylene and styrene, in which the acid makes up at least 50% by weight. Other suitable water-soluble organic builders are terpolymers which contain two unsaturated acids and/or salts thereof as monomers and vinyl alcohol and/or an esterified vinyl alcohol or a carbohydrate as the third monomer. The first acidic monomer or its salt is derived from a monoethylenically unsaturated $C_{3-8}$ carboxylic acid and preferably from a $C_{3-4}$ monocarboxylic acid, more especially (meth)acrylic acid. The second acidic monomer or its salt may be a derivative of a $C_{4-8}$ dicarboxylic acid, maleic acid being particularly preferred, and/or a derivative of an allylsulfonic acid substituted in the 2-position by an alkyl or aryl group. Polymers such as these can be produced in particular by the processes described in German patents DE 42 21 381 and German patent application DE 43 00 772 and generally have a relative molecular weight of 1,000 to 200,000. Other preferred copolymers are the copolymers which are described in German patent applications DE 43 03 320 and DE 44 17 734 and which preferably contain acrolein and acrylic acid/acrylic acid salts or vinyl acetate as monomers. The organic builders may advantageously be used in the form of aqueous solution, preferably in the form of 30 to 50% by weight aqueous solutions, particularly for the production of liquid detergents. All the acids mentioned are generally used in the form of their water-soluble salts, more especially their alkali metal salts.

If desired, organic builders of the type in question may be present in quantities of up to 40% by weight, preferably in quantities of up to 25% by weight and more preferably in quantities of 1% by weight to 8% by weight. Quantities near the upper limit are preferably used in paste-form or liquid, more particularly water-containing detergents.

Suitable water-soluble inorganic builders are, in particular, alkali metal silicates, alkali metal carbonates and alkali metal phosphates which may be present in the form of their alkaline, neutral or acidic sodium or potassium salts. Examples of such builders are trisodium phosphate, tetrasodium diphosphate, disodium dihydrogen diphosphate, pentasodium triphosphate, so-called sodium hexametaphosphate, oligomeric trisodium phosphate with degreess of oligomerization of 5 to 1,000 and more particularly 5 to 50 and the corresponding potassium salts or mixtures of sodium and potassium salts. Crystalline or amorphous alkali metal alumosilicates in quantities of up to 50% by weight and preferably not more than 40% by weight and, in liquid detergents in particular, in quantities of 1 to 5% by weight are used as water-insoluble, water-dispersible inorganic builder materials. Of these inorganic builders, crystalline sodium alumosilicates in detergent quality, more particularly zeolite A, P and optionally X, individually or in the form of mixtures, for example in the form of a co-crystallizate of the zeolites A and X (Vegobond® AX, a product of Condea Augusta S.P.A.), are preferred. Quantities near the upper limit mentioned are preferably used in solid particulate detergents. Suitable alumosilicates contain no particles larger than 30 $\mu$m in size, at least 80% by weight preferably consisting of particles smaller than 10 $\mu$m in size. Their calcium binding capacity, which may be determined in accordance with German patent DE 24 12 837, is generally in the range from 100 to 200 mg CaO per gram.

Suitable substitutes or partial substitutes for the alumosilicate mentioned are crystalline alkali metal silicates which may be present either on their own or in the form of a mixture with amorphous silicates. The alkali metal silicates suitable as builders in the detergents according to the invention preferably have a molar ratio of alkali metal oxide to $SiO_2$ of less than 0.95:1 and, more particularly, in the range from 1:1.1 to 1:12 and may be amorphous or crystalline. Preferred alkali metal silicates are sodium silicates, more especially amorphous sodium silicates, with a molar $Na_2O$:$SiO_2$ ratio of 1:2 to 1:2.8. Those with a molar $Na_2O$:$SiO_2$ ratio of 1:1.9 to 1:2.8 can be produced by the method according to European patent application EP 0 425 427. Crystalline layered silicates with the general formula $Na_2Si_xO_{2x+1}\cdot y\,H_2O$, in which x—the so-called modulus—is a number of 1.9 to 22 and more particularly 1.9 to 4 and y is a number of 0 to 33, preferred values for x being 2, 3 or 4, are preferably used as crystalline silicates which may be present either on their own or in admixture with amorphous silicates. Crystalline layered silicates which correspond to this general formula are described, for example, in European patent application EP 0 164 514. Preferred crystalline layered silicates are those in which x in the general formula shown above assumes a value of 2 or 3. Both [β- and δ-sodium disilicates ($Na_2Si_2O_5.yH_2O$) are particularly preferred, β-sodium disilicate being obtainable for example by the process described in International patent application WO 91/08171. δ-Sodium silicates with a modulus of 1.9 to 3.2 may be produced in accordance with Japanese patent applications JP 04/238 809 or JP 04/260 610. Substantially water-free crystalline alkali metal silicates corresponding to the above general formula, in which x is a number of 1.9 to 2.1, obtainable from amorphous alkali metal silicates as described in European patent applications EP 0 548 599, EP 0 502 325 and EP 0 425 428 may also be used in detergents according to the invention. Another preferred embodiment of the detergents according to the invention is characterized by the use of a crystalline sodium layered silicate with a modulus of 2 to 3 which may be produced from sand and soda by the process according European patent application EP 0 436 835. The crystalline sodium silicates with a modulus of 1.9 to 3.5 which may be obtained by the processes according to European patents EP 0 164 552 and/or EP 0 294 753 are used in a another preferred embodiment of the detergents according to the invention. Crystalline layer silicates corresponding to formula (I) are marketed, for example, by Clariant GmbH under the trade name Na-SKS, including for example Na-SKS-1 ($Na_2Si_2O_5.xH_2O$, kenyaite) Na-SKS-2 (α-$Na_2Si_2O_5$), Na-SKS-7 (β-$Na_2Si_2O_5$ natrosilite), NaSKS-9 ($NaHSi_2O_5.H_2O$), NaSKS-10 ($NaHSi_2O_5.3H_2O$, kanemite), Na-SKS-11 ($\tau$-$Na_2Si_2O_5$) and Na-SKS-13 ($NaHSi_2O_5$), but especially NaSKS-6 ($\delta$-$Na_2Si_2O_5$) are particularly suitable. An overview of crystalline layer silicates can be found, for example, in the articles published in "Hoechst High Chem Magazin 14/1993", pages 33–38 and in "Seifen-Öle-Fefte-Wachse", Vol. 116, No. 20/1990", pages 805–808. Another preferred embodiment of the detergents according to the invention is characterized by the use of the granular compound of crystalline layered silicate and citrate, of crystalline layered silicate and the above-mentioned (co) polymeric polycarboxylic acid, as described for example in German patent application DE 198 19 187, or of alkali metal silicate and alkali metal carbonate, as described, for example, in International patent application WO 95/22592 or as commercially obtainable, for example, under the name of Nabion® 15.

Builders may optionally be present in the detergents according to the invention in quantities of up to 90% by weight and are preferably present in quantities of up to 75% by weight. Laundry detergents according to the invention have builder contents of, in particular, 5% by weight to 50% by weight. In hard-surface cleaning compositions, more particularly dishwasher detergents, according to the invention, the builder content is in particular between 5% by weight and 88% by weight, such compositions preferably being free from water-insoluble builders. Another preferred embodiment of the dishwasher detergents according to the invention contains 20% by weight to 40% by weight of a water-soluble organic builder, more particularly alkali metal citrate, 3% by weight to 15% by weight of alkali metal carbonate and 20% by weight to 40% by weight of alkali metal disilicate.

In addition to the bleach-activating compound corresponding to formula I, typical compounds which form peroxocarboxylic acid under perhydrolysis conditions—so-called bleach activators—may be used. These bleach activators may be in particular compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran and the enol esters known from German patent applications DE 196 16 693 and DE 196 16 767, acetylated sorbitol and mannitol and the mixtures thereof (SORMAN) described in European patent application EP 0 525 239, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO 94/27970, WO 94/28102, WO 94/28103, WO 95/00626, WO 95/14759 and WO 95/17498. The substituted hydrophilic acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Bleach activators such as these are present in the usual quantities, preferably in quantities of 0.5% by weight to 10% by weight and more preferably in quantities of 1% by weight to 8% by weight, based on the detergent as a whole. In addition to or instead of the conventional bleach activators mentioned above, the sulfonimines known from European patents EP 0 446 982 and EP 0 453 003 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592, the cobalt complexes known from International patent applications WO 96/23859, WO 96/23860 and 96/23861 and/or the manganese complexes described in European patent EP 0 443 651 or in European patent applications EP 0 458 397, EP 0 458 398, EP 0 549 271, EP 0 549 272, EP 0 544 490 and EP 0 544 519. The bleach-boosting active-substance combination obtainable in accordance with European patent application EP 0 832 969 may also be used in detergents according to the invention. Combinations of bleach activators and transition metal bleach catalysts are known, for example, from German patent application DE 196 13 103 and from international patent application WO 95/27775. Bleach-boosting transition metal complexes, more particularly with the central atoms Mn, Fe, Co. Cu, Mo. V, Ti and/or Ru, are used in typical quantities, preferably in a quantity of up to 1% by weight, more preferably in a quantity of 0.0025% by weight to 0.25% by weight and most preferably in a quantity of 0.01% by weight to 0.1% by weight, based on the detergent as a whole.

Enzymes suitable for use in the detergents according to the invention are those from the class of cutinases, pullulanases, hemicellulases, oxidases, laccases and peroxidases and mixtures thereof. Enzymes obtained from fungi or bacteria, such as Bacillus subtilis, Bacillus licheniformis, Bacillus lentus, Streptomyces griseus, Humicola lanuginosa, Humicola insolens, Pseudomonas peudoalcaligenes, Pseudomonas cepacia and Coprinus cinereus are particularly suitable. The enzymes may be adsorbed to supports and/or embedded in shell-forming materials to protect them against premature inactivation, as described for example in European patent EP 0 564 476 or in International patent application WO 94/23005. They are present in the detergents according to the invention in quantities of preferably up to 5% by weight and, more preferably, 0.2% by weight to 2% by weight.

The organic solvents suitable for use besides water in the detergents according to the invention, particularly where they are present in liquid or paste-like form, include $C_{1-4}$ alcohols, more especially methanol, ethanol, isopropanol and tert. butanol, $C_{2-4}$ diols, more especially ethylene glycol and propylene glycol, and mixtures thereof and ethers derived from the classes of compound mentioned. Water-miscible solvents such as these are present in the detergents according to the invention in quantities of preferably not more than 30% by weight and, more preferably, between 6% by weight and 20% by weight.

The detergents may additionally contain other typical detergent ingredients. These optional constituents include, in particular, enzyme stabilizers, redeposition inhibitors, dye transfer inhibitors, foam inhibitors and optical brighteners and also dyes and perfumes. To protect silverware against corrosion, dishwasher detergents according to the invention may contain silver corrosion inhibitors. In addition, a hard-surface detergent according to the invention may contain abrasive ingredients, more especially from the group consisting of silica flours, wood flours, polymer powders, chalks and glass microbeads and mixtures thereof. Abrasives are present in the dishwasher detergents according to the invention in quantities of preferably not more than 20% by weight and, more particularly, in quantities of 5% by weight to 15% by weight.

To establish a desired pH value which is not spontaneously adjusted by the mixture of the other components, the detergents according to the invention may contain system-compatible and environmentally compatible acids, more particularly citric acid, acetic acid, tartaric acid, malic acid, lactic acid, glycolic acid, succinic acid, glutaric acid and/or adipic acid and also mineral acids, more especially sulfuric acid, or bases, more especially ammonium or alkali metal hydroxides. pH regulators such as these are present in the detergents according to the invention in quantities of preferably not more than 20% by weight and, more preferably, between 1.2% by weight and 17% by weight.

Dye transfer inhibitors suitable for use in laundry detergents according to the invention include, in particular, polyvinyl pyrrolidones, polyvinyl imidazoles, polymeric N-oxides, such as poly-(vinylpyridine-N-oxide) and copolymers of vinyl pyrrolidone with vinyl imidazole.

The function of redeposition inhibitors is to keep the soil detached from the fibers suspended in the wash liquor. Suitable redeposition inhibitors are water-soluble, generally organic colloids, for example starch, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example aldehyde starches, may also be used. Cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, are also preferably used, for example in quantities of 0.1 to 5% by weight, based on the detergent.

To enhance their cleaning performance, the detergents according to the invention may in particular contain soil-release polymers which are generally composed of carboxylic acid units and optionally polymeric diol units and, for example, may contain ethylene terephthalate and polyoxyethylene terephthalate groups. Other monomer units, for example propylene glycol, polypropylene glycol, alkylene or alkenylene dicarboxylic acids, isophthalic acid, carboxy- or sulfo-substituted phthalic acid isomers, may also be present in the soil-release polymer. End-capped derivatives, i.e. polymers which contain neither free hydroxyl groups nor free carboxyl groups, but $C_{1-4}$ alkyl groups for example, or which are terminally esterified with monobasic carboxylic acids, for example benzoic acid or sulfobenzoic acid, may also be used. Also suitable are the polyesters known from European patent application EP 0 241 985 which, besides oxyethylene groups and terephthalic acid units, contain 1,2-propylene, 1,2-butylene and/or 3-methoxy-1,2-propylene groups and glycerol units and which are end-capped with $C_{1-4}$ alkyl groups, the soil-release polymers of ethylene terephthalate and polyethylene oxide terephthalate with a molecular weight of 900 to 9000 used in the detergents of European patent application EP 0 253 567 (the polyethylene glycol units having molecular weights of 300 to 3000 and the molar ratio of ethylene terephthalate to polyethylene oxide terephthalate being 0.6 to 0.95:1), the polyesters containing polypropylene terephthalate and polyoxyethylene terephthalate units at least partly end-capped by $C_{1-4}$ alkyl or acyl groups which are known from European patent application EP 0 272 033, the sulfoethyl-end-capped terephthalate-containing soil-release polyesters mentioned in European patent application EP 0 274 907, the soil-release polyesters containing terephthalate, alkylene glycol and poly-$C_{2-4}$-glycol units prepared by sulfonation of unsaturated terminal groups according to European patent application EP 0 357 280, the cationic soil-release polyesters containing amine, ammonium and/or amine oxide groups known from European patent application EP 0 398 133 and the cationic soil-release polyesters containing ethoxylated quaternized morpholine units according to European patent application EP 0 398 137. Also suitable are polymers of ethylene terephthalate and polyethylene oxide terephthalate, in which the polyethylene glycol units have molecular weights of 750 to 5000 and the molar ratio of ethylene terephthalate to polyethylene oxide terephthalate is 50:50 to 90:10 and of which the use in detergents is described in DE 28 57 292, and polymers of ethylene terephthalate and polyethylene oxide terephthalate with molecular weights of 15,000 to 50,000 (the polyethylene glycol units having molecular weights of 1000 to 10,000 and the molar ratio of ethylene terephthalate to polyethylene oxide terephthalate being 2:1 to 6:1) which may be used in detergents according to German patent application DE 33 24 258.

Laundry detergents according to the invention may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned may also be used.

Particularly where the detergents are used in washing machines, it can be of advantage to add typical foam inhibitors to them. Suitable foam inhibitors are, for example, soaps of natural or synthetic origin which have a high percentage content of $C_{18-24}$ fatty acids. Suitable non-surface-active foam inhibitors are, for example, organopolysiloxanes and mixtures thereof with microfine, optionally silanized, silica and also paraffins, waxes, microcrystalline waxes and mixtures thereof with silanized silica or bis-stearyl ethylenediamide. Mixtures of different foam inhibitors, for example mixtures of silicones, paraffins and waxes, may also be used with advantage. The foam inhibitors, more particularly silicone- and/or paraffin-containing foam inhibitors, are preferably fixed to a granular water-soluble or water-dispersible support. Mixtures of paraffins and bis-stearyl ethylenediamides are particularly preferred.

The production of solid detergents according to the invention does not involve any difficulties and may be carried out in known manner, for example by spray drying or granulation, the enzymes and any other heat-sensitive ingredients, for example bleaching agents, optionally being separately added at a later stage. Detergents according to the invention having a high bulk density, more particularly in the range from 650 to 950 g/l, are preferably produced by the process comprising an extrusion step which is known from European patent EP 0 486 592. Another preferred production process is the granulation process according to European patent EP 0 642 576.

To produce detergents according to the invention in the form of tablets which comprise one or more phases and are colored in one or more colors and, in particular, may consist of one layer or several layers, more particularly two layers, all the ingredients—optionally for each layer—may be mixed together in a mixer and the resulting mixture tabletted in conventional tablet presses, for example eccentric presses or rotary presses. In the case of multilayer tablets in particular, it can be of advantage if at least one layer is compressed in advance. A tablet produced in this way preferably has a weight of 10 g to 50 g and, more particularly, 15 g to 40 g. The tablets may be of any shape, including round, oval or angular and variations thereof. Corners and edges are advantageously rounded off. Round tablets preferably have a diameter of 30 mm to 40 mm. The size of rectangular or square tablets in particular, which are mainly introduced from dispensing compartments, for example of dishwashers, is dependent on the geometry and the size of the dispensing compartment. For example, preferred embodiments have a base area of (20 to 30 mm)×(34 to 40 mm) and, more particularly, 26×36 mm or 24×38 mm.

Liquid or paste-form detergents according to the invention in the form of solutions containing typical solvents are generally prepared simply by mixing the ingredients which may be introduced into an automatic mixer either as such or in the form of a solution.

EXAMPLES

In order to determine washing performance, cofton fabrics soiled with standardized test soils (A: blood/milk/soot; B: tea) were washed at 30° C. (detergent dose 76 g; water hardness 17° d; load 3.5 kg; normal program) in a domestic washing machine (Miele® 701). Table 1 below shows the washing results (reflectance values at 460 nm; triple determination) for a detergent C1 which, besides 17% by weight sodium percarbonate, contained 1.7% by weight enzyme granules (amylase/protease/lipase/cellulase) and 7% by weight of TAED (balance to 100% surfactants, builder, foam inhibitor, filler salts) and for detergents M1 and M2 according to the invention which, instead of the conventional bleach activator TAED, contained 1% by weight and 4% by weight of trimethyl ammonium acetonitrile chloride (=cyanomethyl trimethyl ammonium chloride), but which otherwise had the same composition as C1.

TABLE 1

| | Washing results (% reflectance) | |
|---|---|---|
| | A | B |
| C1 | 61.4 | 49.6 |
| M1 | 69.0 | n.d. |
| M2 | n.d. | 54.2 |

n.d. not determined

It can be seen that, for the same enzyme content, detergents according to the invention have a distinctly better cleaning performance against enzymatically removable soils (A) and against bleachable soils (B) than a comparison detergent with a higher content of a conventional bleach activator.

What is claimed is:

1. A detergent composition comprising;

(a) 1% to 10% by weight of a bleach activator compound corresponding to general formula I:

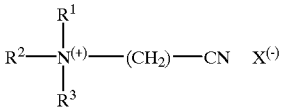

(I)

wherein $R^1$ is —H, —$CH_3$, a $C_{2-24}$ alkyl or alkenyl group, a substituted $C_{2-24}$ alkyl or alkenyl group with at least one substituent from the group consisting of —Cl, —Br, —OH, —$NH_2$, —CN, an alkyl or alkenyl aryl group containing a $C_{1-24}$ alkyl group or a substituted alkyl or alkenyl aryl group containing a $C_{1-24}$ alkyl group and at least one other substituent at the aromatic ring, $R^2$ and $R^3$ independently of one another are selected from the group consisting of —$CH_2$—CN, —$CH_3$, —$CH_2$—$CH_3$, —$CH_2$—$CH_2$—$CH_3$, —$(_3)$H —$CH_3$, —$CH_2$—OH, —$CH_2$—$CH_2$—OH, —CH —CH (OH) $CH_3$, —$CH_2$—$CH_2$—$CH_2$—OH, —$CH_2$(OH)—$CH_3$, —CH(OH)—$CH_2$—$CH_3$, and —$CH_2CH_2$—O)$_n$H wherein n=1, 2, 3, 4, 5 or 6, and wherein X is an anion;

(b) an enzyme selected from the group consisting of protease, amylase, lipase, cellulase, and mixtures thereof, wherein said enzyme provides said detergent with 0.001 mag to 0.5 mg of enzymatically active protein per gram of detergent; and (c) a bleach; and (d) one or more compounds that form a peroxocarboxylic acid under perhydrolysis conditions.

2. The detergent composition of claim 1 comprising 5 to 30 percent by weight of said bleach.

3. The detergent composition of claim 2 comprising 8 to 25 percent by weight of said bleach.

4. The detergent composition of claim 1 wherein said bleach is an oxygen-based bleaching agent.

5. The detergent composition of claim 4 wherein said oxygen-based bleaching agent comprises a peroxygen compound selected from the group consisting of hydrogen peroxide, alkali metal perborate, alkali metal percarbonate, organic per acids, and mixtures thereof.

6. The detergent composition of claim 1 wherein in the compound corresponding to formula I, the substituents $R^1$, $R^2$ and $R^3$ are the same.

7. The detergent composition of claim 6 wherein in the compound corresponding to formula I, the substituents $R^1$, $R^2$ and $R^3$ are all methyl groups.

8. The detergent composition of claim 1 wherein in the compound corresponding to formula I, the charge-compensating anion $X^-$ is selected from the group consisting of halides, chloride, fluoride, iodide, bromide, nitrate, hydroxide, hexafluorophosphate, sulfate, hydrogen sulfate, metho- and ethosulfate, chlorate, perchlorate, and the anions of carboxylic acids.

9. The detergent composition of claim 8 wherein said anions of carboxylic acids comprise formate, acetate, benzoate, or citrate.

10. The detergent composition of claim 1 comprising 2 to 7 percent by weight of said compound corresponding to general formula I.

11. The detergent composition of claim 1 comprising 0.02 mg to 0.3 mg of enzymatically active protein per gram.

12. The detergent composition of claim 1 having a proteolytic activity of 100 PU/g to 7500 PU/g.

13. The detergent composition of claim 12 having a proteolytic activity 125 PU/g to 5000 PU/g.

14. The detergent composition of claim 1 having a lipolytic activity of 10 LU/g to 10,000 LU/g.

15. The detergent composition of claim 14 having a lipolytic activity of 80 LU/g to 5000 LU/g.

16. The detergent composition of claim 1 having an amylolytic activity of 0.01 KNU/g to 2 KNU/g.

17. The detergent composition of claim 16 having an amylolytic activity of 0.015 KNU/g to 1.8 KNU/g.

18. The detergent composition of claim 1 having a cellulolytic activity of 0.05 IU/g to 1.5 IU/g.

19. The detergent composition of claim 18 having a cellulolytic activity of 0.07 IU/g to 1.4 IU/g.

20. The detergent composition of claim 1 comprising 0.5 to 10 percent by weight of compounds which form peroxocarboxylic acids under perhydrolysis conditions.

21. The detergent composition of claim 20 comprising 1 to 8 percent by weight of compounds which form peroxocarboxylic acids under perhydrolysis conditions.

22. The detergent composition of claim 1 further comprising bleach-catalyzing transition metal salts or complexes.

23. The detergent composition of claim 22 comprising 0.001 to 0.5 percent by weight of said bleach-catalyzing transition metal salts or complexes.

24. A process for increasing the cleaning performance of detergents comprising forming a detergent solution comprising the detergent composition of claim 1.

25. The process of claim 24 wherein the bleach in said detergent solution comprises a peroxygen compound.

26. A process for cleaning soils comprising forming the detergent composition of claim 1 and contacting said solution with a surface containing protein, starch, or colored soils.

27. The process of claim 26 wherein said soils are tea-based.

* * * * *

UNITED STATES PATENT AND TRADEMARK OFFICE

CERTIFICATE OF CORRECTION

PATENT NO. : 6,391,838 B1
DATED : May 21, 2002
INVENTOR(S) : Speckmann et al.

It is certified that error appears in the above-identified patent and that said Letters Patent is hereby corrected as shown below:

Title page,
Item [57], ABSTRACT,
Line 23, between "$R^2$" and "$R^3$", delete "ad", and insert therefor
-- and --.

Column 16,
Line 19, delete ";", and insert therefor -- : --.
Line 38, delete "-($_3$)H", and insert therefor -- -CH($CH_3$) --.
Line 39, delete the last "-CH" in the line.
Line 40, delete "(OH)$CH_3$", and insert therefor -- (OH)-$CH_3$ --
Line 40, delete "-$CH_2$(OH)-$CH_3$", and insert therefor -- -$CH_2$-CH(OH)-$CH_3$ --.
Line 41, delete "-$CH_2CH_2$-O)$_n$H", and insert therefor -- -($CH_2CH_2$-O)$_n$H --.
Line 45, after "0.001", delete "mag", and insert therefor -- mg --.

Signed and Sealed this

Nineteenth Day of August, 2003

JAMES E. ROGAN
*Director of the United States Patent and Trademark Office*